US012680230B2

(12) United States Patent
Ghelli et al.

(10) Patent No.: US 12,680,230 B2
(45) Date of Patent: Jul. 14, 2026

(54) PAPER MAKING MACHINE AND PROCESS

(71) Applicant: TOSCOTEC S.P.A., Capannori (IT)

(72) Inventors: Luca Ghelli, Turin (IT); Paolo Raffaelli, Lucca (IT); Gaetano Passanisi, Capannori (IT); Francesco Simoncini, San Lorenzo a Vaccoli (IT)

(73) Assignee: Toscotec S.p.a., Capannori (IT)

( * ) Notice: Subject to any disclaimer, the term of this patent is extended or adjusted under 35 U.S.C. 154(b) by 299 days.

(21) Appl. No.: 18/265,251

(22) PCT Filed: Nov. 30, 2021

(86) PCT No.: PCT/IT2021/050386
§ 371 (c)(1),
(2) Date: Jun. 4, 2023

(87) PCT Pub. No.: WO2022/118354
PCT Pub. Date: Jun. 9, 2022

(65) Prior Publication Data

US 2024/0003085 A1 Jan. 4, 2024

(30) Foreign Application Priority Data

Dec. 4, 2020 (IT) ..... 102020000029900

(51) Int. Cl.

| | |
|---|---|
| ***D21F 9/02*** | (2006.01) |
| ***D21F 3/02*** | (2006.01) |
| ***D21F 3/10*** | (2006.01) |
| ***D21F 5/18*** | (2006.01) |
| ***D21F 7/08*** | (2006.01) |
| ***D21F 11/02*** | (2006.01) |

(52) U.S. Cl.
CPC ..... *D21F 9/02* (2013.01); *D21F 3/0218* (2013.01); *D21F 3/10* (2013.01); *D21F 5/181* (2013.01); *D21F 7/083* (2013.01); *D21F 11/02* (2013.01)

(58) Field of Classification Search
CPC . D21F 9/02; D21F 3/0218; D21F 3/10; D21F 5/181
USPC ..... 162/207
See application file for complete search history.

(56) References Cited

U.S. PATENT DOCUMENTS

| | | | | |
|---|---|---|---|---|
| 2002/0060042 | A1 | 5/2002 | Klerelid et al. | |
| 2003/0136018 | A1* | 7/2003 | Herman | F26B 13/16 34/114 |
| 2018/0140529 | A1* | 5/2018 | Miller, IV | A61K 8/8135 |

FOREIGN PATENT DOCUMENTS

| | | | |
|---|---|---|---|
| DE | 102008054990 | A1 | 6/2010 |
| WO | 2019201861 | A1 | 10/2019 |

* cited by examiner

*Primary Examiner* — Jacob T Minskey
(74) *Attorney, Agent, or Firm* — Rivka Friedman

(57) ABSTRACT

Paper making machine comprising a forming zone in which a layer of fibrous material is formed, a zone for forced removal of water from the fibrous material layer downstream of the forming zone, a drying zone downstream of the forced removal of the water, and a paper collection zone downstream of the drying zone, and means for transporting the layer of fibrous material through said zones of the machine along a path that follows a predetermined transport direction (MD). The forced water removal zone comprises, in turn, two consecutive zones (Z1, Z2) along said transport direction (MD), in which a capillary roller (44) and a pressure element (4S) with a respective counter-roller (4C) are respectively arranged, acting consecutively on the layer of fibrous material upstream of the drying zone.

13 Claims, 8 Drawing Sheets

PAPER MAKING MACHINE AND PROCESS

The present invention relates to a machine and a process for producing paper.

It is known that the paper making machines, for example for the production of tissue paper from which products such as paper napkins, toilet paper, kitchen paper, nose tissues and similar products are obtained, make use a fibrous mixture containing cellulosic fibers in aqueous suspension and, in general, additives intended to give the finished paper certain chemical-physical characteristics and to improve the operating conditions of the production process. The mixture, having a low fiber content in relation to the water, is distributed by means of a headbox on a formation system which generally comprises a formation wire possibly associated with a felt. A layer of fibrous material is therefore generated from the mixture after a progressive removal of water which determines a higher percentage of fibers. Subsequently, the layer of fibrous material is transferred to a drying system which for example includes a Yankee cylinder, around which the cellulosic layer is passed to be dried. The ply of cellulosic material is then detached from the Yankee to be wound in the form of a reel or subjected to other processes. To date, the best quality tissue products in terms of bulkiness, absorption capacity, optimized use of fibers (lower quantity of fiber per product surface) and strength, are obtained by TAD (Through Air Drying) machines, where a great contribution to the drying of the product is given by the TAD section that uses the passage of large streams of hot air through the sheet being dried. This technology is widely and widespread used especially in those countries where energy costs are low, given the high thermal and electrical power required to move the necessary hot air flows.

The present invention relates, in particular, to the steps of removing water from the layer of fibrous material and forming the final structure of the ply and aims at improving the related processes both in terms of energy efficiency and in terms of quality of the finished product. Another aim of the present invention is to provide a paper production system as an alternative to the existing systems. Yet another aim of the present invention is to provide a machine which, in addition to ensuring the aforementioned advantages, is easily reconfigurable to produce both structured and unstructured paper in a wide range of grades, thus ensuring production flexibility in line with the current industrial needs.

This result has been achieved, in accordance with the present invention, by means of a machine and a process having the characteristics indicated in the independent claims. Other characteristics of the present invention are the subject of the dependent claims.

Thanks to the present invention, it is possible to produce high quality structured paper, comparable to that obtained in TAD type plants, reducing the overall thermal and electrical power required. Furthermore, a machine according to the present invention is capable of producing both high quality structured paper and crepe paper, thus allowing to obtain further reductions in energy consumption by giving up the production of high quality paper. These characteristics allow to obtain a high flexibility, allowing to adapt the production to the current production needs.

These and further advantages and characteristics of the present invention will be better understood by every person skilled in the art thanks to the following description and the attached drawings, provided by way of example but not to be considered in a limiting sense, in which.

Figure 1:
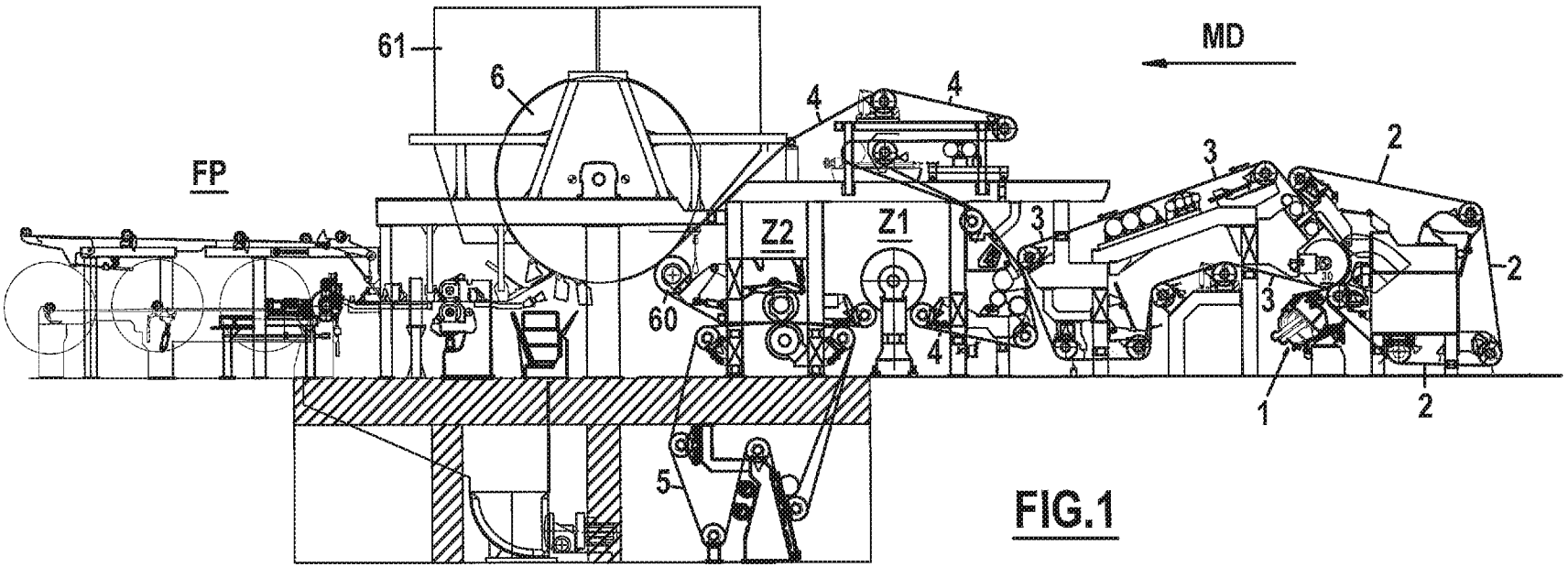
FIG. 1 represents a schematic side view of a paper making machine according to the present invention.
Figure 2:
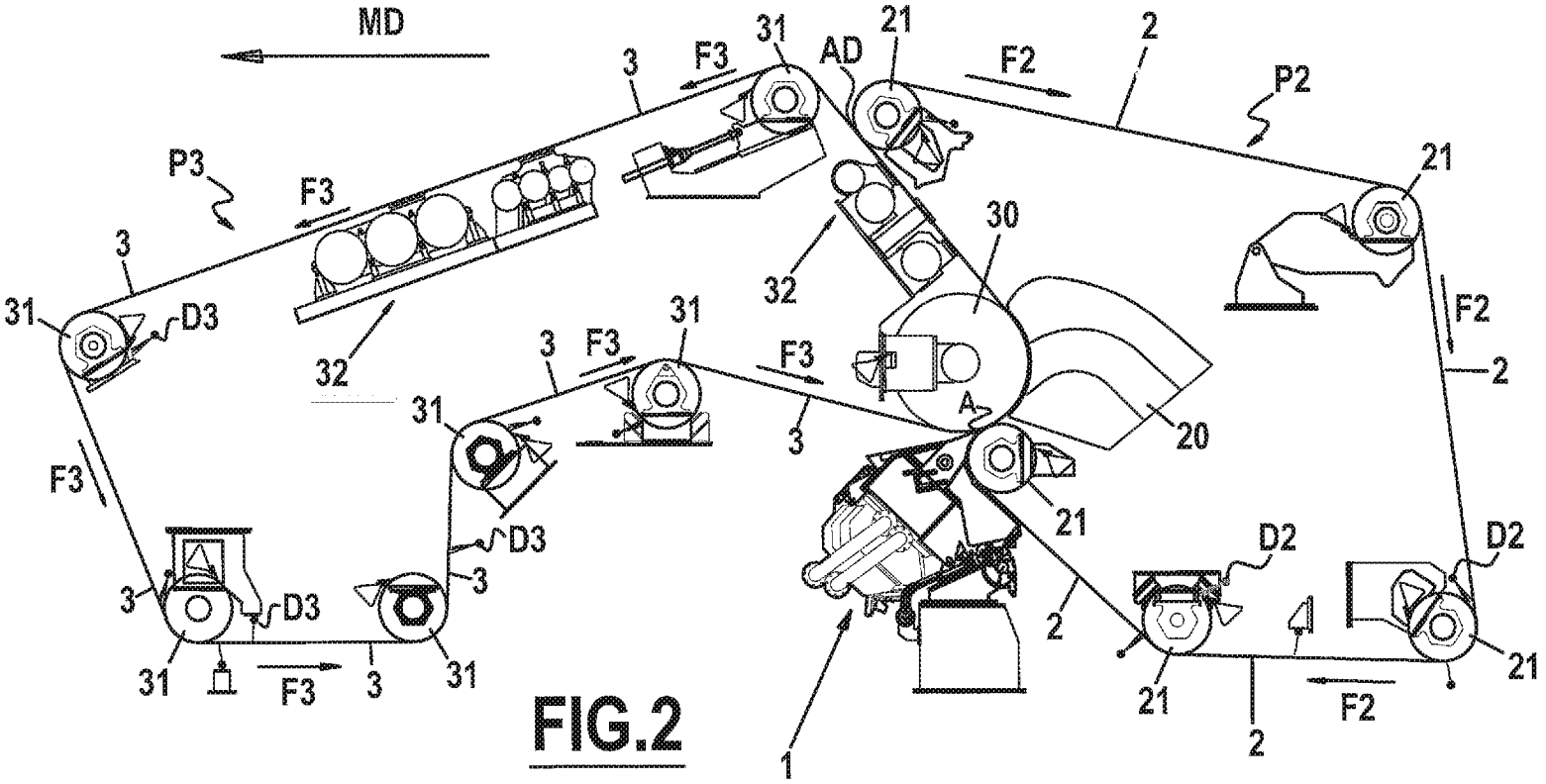
FIGS. 2-4 are enlarged details of FIG. 1, some parts of which are not shown in order to better highlight others.

Reduced to its essential structure and with reference to the accompanying exemplificative drawings, a machine according to the present invention comprises:

- a formation zone, in which means are arranged to feed a fibrous suspension, of known composition, and means configured to receive said suspension and transport it along a predetermined path causing a progressive dehydration of the layer of fibrous material thus produced;
- a zone of forced removal of water downstream of the formation zone;
- a drying zone downstream of the forced water removal zone, in which means for drying the layer of fibrous material formed in the formation zone are arranged;
- a paper ply collection zone downstream of the drying zone, in which ply collection means are arranged to collect the ply according to a predefined configuration, for example in form of reels.

For example, the fibrous suspension feeding means comprise a headbox (1), known per se.

The forming means can comprise, for example, two wires (2, 3), with a forming wire (2) and a conveyor web (3) between which the fibrous suspension is fed. The forming wire (2) and the conveyor web (3) can be of the type normally used in paper making machines, so that the web (3) can also be a wire. In this case, the aqueous suspension is fed from the headbox into a zone (A) of convergence of the formation wire (2) and the conveyor web (3). According to a per se known configuration, the conveyor web (3) is guided over a corresponding cylinder (30) arranged immediately downstream of the headbox (1) and, in a position opposite to the cylinder (30) with respect to the wire (2) and the web (3), there is a conveyor (20) of the water removed by centrifugation and drained through the wire (2) whose water collection area develops along an arc of predetermined width of the path followed by the same wires downstream of the headbox (1). The formation wire (2) develops along a closed path (P2) defined by a plurality of rollers (21) arranged in predetermined positions along this path which have the function of guides, guiding and tensioning the wire. The movement of the formation wire (2) along the path (P2) is indicated by the arrows "F2" in the drawings. One or more rollers (21) can be motorized or rotated by motor means (not visible in the drawings). The rollers (21) can also be dragged (all or some of them) by the friction exerted by the wire (2) wrapped around them and moved by other means such as the cylinder (30), in turn motorized.

Similarly, the conveyor web (3) develops along a respective closed path (P3) defined by a plurality of rollers (31) arranged in predetermined positions along this path and having the function of guides, guiding and tensioning the web. (3). The movement of the transport wire (3) along the path (P3) is indicated by the arrows "F3". One or more guide rollers (31) can be motorized or rotated by motor means (not visible in the drawings). The rollers (31) can also be dragged (all or some of them) by the friction exerted by the web (3) wrapped around them and moved by other means such as the cylinder (30), in turn motorized.

Along said paths (P2, P3) spray or needle type washing devices can be arranged, oscillating in the direction transverse to the motion of the webs or fixed (D2, D3) acting on the wire (2) and on the web (3), as well as on the rollers (21, 31) in a manner known per se.

The paths (P2, P3) of the wire (2) and the web (3) have a common section downstream of the headbox (1), between the said convergence area (A) and a point (AD) in which the same paths diverge.

Along the path (P3) of the conveyor web (3), suction boxes (32) can be arranged acting on the internal side of the same web (3), or on the side facing the inside of the path (P3).

With reference to the example shown in FIGS. 1-4, the conveyor web (3) conveys the layer of fibrous material, which is produced downstream of the headbox (1), towards and up to another web (4) arranged downstream with respect to the direction (MD) generally followed by the fibrous material inside the machine. The web (4) can conveniently be a structured wire of the TAD type, a felt or any other type of web suitable to support the layer of fibrous material such as, for example, a polyurethane web that is normally reinforced by a wire embedded in polyurethane, which may have projections on the paper side or holes to allow water to drain, despite the impermeability of the polyurethane. The web (4) can also be a felt with projections forming a grid typically made of polyurethane, made on the paper side.

The web (4) is closed in a loop along a respective path (P4) which has a branch where an output side of the conveyor web (3) converges. The path (P4) is defined by a plurality of corresponding rollers (41) on which the web (4) is guided. In the drawings, the reference "CF" indicates the zone of the machine where the conveyor web (3) and the web (4) converge. In the "CF" zone the layer of fibrous material is transferred from the conveyor web (3) to the web (4).

In a preferred configuration, the web (4) is a structured wire of the TAD type, which is constituted, in a per se known way, of a flexible support having an external side on which depressions are formed, for example in the form of pockets of predetermined shape and size, and projections that give the cellulosic layer a substantially three-dimensional structure, i.e. a non-planar structure. The internal side of the web (4) is the one facing the inside of the path (P4). The arrows "F4" indicate the movement of the web (4) along the path (P4). One or more rollers (41) can be motorized or rotated by motor means (not visible in the drawings). The rollers (41) can also be dragged (all or some of them) by the friction exerted by the web (4) wrapped around them and moved by other means such as by the friction between the motorized drying cylinder (6) and the pressure element (60) described below.

The web (4), in the preferred configuration, is, for example, a wire TAD or structured wire (4) which, for example, can be of the type described in U.S. Pat. No. 8,328,990B2.

In the area (CF) the transfer of the layer of fibrous material from the conveyor web (3) to the web (4) preferably takes place, in the case in which the web (4) is a structured wire, in "rush transfer" mode, that is with a predetermined difference between the speed of the conveyor web (3), which is faster, and the speed of the web (4), which is slower. In this way, the fibers of the paper being formed are forced to fill the cavities of the structured wire, realizing the so-called structuring of the paper, that is the passage from a substantially planar structure to a non-planar structure. For example, the speed difference between the conveyor web (3) and the web (4) is less than 8% (preferably between 2% and 5%) for low weight paper such as toilet paper, while it is between 7% and 25% (preferably between 10% and 15%) for heavier weight paper such as towel type paper. In this phase the dry content of the sheet (percentage by weight of the fibers in the fibrous material transferred to the web 4) is comprised between 10% and 30% and more preferably between 15% and 20%.

A suction box (42) can be arranged in correspondence with said transfer area (CF) which serves to facilitate the transfer from the conveyor web (3) to the web (4) and to further force the insertion of the fibers into the cavities of the web (4) in case the latter is a structured wire. The suction box (42) is arranged inside the path (P4) followed by the web (4). Preferably, downstream of the suction box (42) with respect to the direction (F4) of motion of the web (4), a further suction box (43) is arranged to further facilitate the adhesion of the fibrous material in the cavities of the web (4), in case this is a structured wire (4).

Along the path (P4) of the web (4) there are two zones (Z1, Z2) for the forced removal of water from the layer of fibrous material transported by the same web (4) which, before reaching the first zone (Z1), has a dry content between 20% and 35% and, preferably, a dry content between 22% and 28%.

In the first area (Z1) of forced water removal, arranged downstream of the transfer area (CF) with respect to the direction (F4) of motion of the web (4), a capillary roller (44) is positioned.

The capillary roller (44) is a per se known device, for example of the type described in U.S. Pat. No. 5,701,682 to which reference can be made for a more detailed description. In practice, the capillary roller (44) is a roller for the dehydration of fibrous webs, in particular for the dehydration of fibrous webs in paper making machines, consisting of a drum (45) rotating around an axis transverse to the direction (MD) followed by the layer of fibrous material to be dehydrated and provided with a capillary membrane (46) on its surface, with which the layer of fibrous material comes into contact. The capillary membrane is preferably constituted by a very thin mesh of metal fabric with a structure comparable to that of a perforated surface with an equivalent diameter of the holes between 2 Dm and 20 pm, preferably between 4 pm and 8 pm. The capillary membrane can also be made of a very fine mesh in plastic materials or from suitably perforated membranes. The membrane can be made of a single layer or multiple layers with progressively coarser meshes or perforations (in the sense that the equivalent diameter of the permeable areas of the mesh or of the passage holes increases) increasing from the external surface of the membrane towards the internal surface.

The layer of fibrous material intended to be transformed into paper, which contains free water between the fibers, being transported by the web (4), comes into contact with the capillary membrane (46) which must be saturated with water to produce a condition of continuity between the water of the membrane and the water of the fibrous material. By capillarity, a certain amount of water is consequently removed from the fibrous material and attracted by the capillary holes (or by the permeable spaces between the meshes, of capillary size) of the membrane (46). A suction is produced inside the drum (45) which keeps active the process of removing water from the fibrous material by capillarity. The extent of suction in the drum (45) depends on the specific nature of the membrane (46) and, generally, it is between −50 kPa and −10 kPa, preferably between −25 kPa and −20 kPa. In practice, said suction is of such a magnitude as to ensure the complete evacuation of the water from the pores of the capillary membrane without, however, causing aspiration of air from the outside. In general, this system is all the more efficient the higher the suction produced in the drum (45) is, but lower than the maximum value ("break-through pressure") characteristic of the capillary membrane used, since this allows to maintain active the process of capillary removal of the water that passes from the layer of fibrous material to the capillary membrane. The advantage in the use of this system derives from the fact that the passage of water from the sheet to the drum (45) occurs without air flows. The capillary passages always remain full of water (during contact with the paper) and the vacuum produced inside the drum (45) in the sector thereof in contact with the paper serves only to keep active the movement of water from the sheet towards the inside of the drum. The lack of an air flow reduces the energy consumption of the vacuum creation systems, whose task remains solely to maintain the vacuum level established in order to support the process of capillary removal of water from the layer of fibrous material.

In a less advantageous configuration from the energetic point of view, the drum (45) can have inside it and in correspondence with the final part of the contact with the sheet, a suction sector in which a vacuum level higher than the "break-through pressure" is applied: in correspondence with this sector there is also the passage of air through the membrane. This configuration may be preferable when a higher concentrated dehydration capacity in the sector (Z1) is required but with a lower overall energy efficiency.

In accordance with what is exemplified in the drawings, the web (4) conveys the fibrous material around a guide roller (47) entering the section (Z1) placed near, or in contact with, the capillary roller (44). The vacuum sector of the capillary roller (44) begins at the point of tangency of the web (4) with the capillary roller (44). The inlet roller (47) can be pressed against the capillary roller (44) to form a useful nip to facilitate the creation of the continuity between the water of which the capillary membrane is saturated and the water contained in the layer of fibrous material conveyed by web (4). The continuity of the water between the layer of fibrous material and the capillary membrane facilitates the activation of the dehydration process due to the capillary effect. The fibrous material detaches from the capillary membrane following the path of the web (4), guided by an exit guide roller (48), before exiting the section (Z1). The exit guide roller (48) can also be pressed against the capillary membrane, in this case in order to facilitate the detachment of the forming paper from the membrane and the maintenance of its adhesion to the web (4). The inlet roller (47) can be replaced by a perforated pressure cylinder provided with a blowing sector in correspondence with the area of possible pressure with the membrane, in order to favor the contact of the layer of fibrous material with the wet membrane. The output roller (48) can be replaced by a perforated pressure cylinder equipped with a suction sector in correspondence with the area of possible pressure with the membrane, in order to facilitate the detachment of the sheet from the membrane and the restoration of adhesion with the web (4) (in this case it works like a "pick-up" roller).

Both rollers (47) and (48) can be mounted on mobile devices and adjustable in their movement to allow the realization of both a pressure action towards the capillary roller and to have a respective gap.

The dry content of the fibrous material downstream of the capillary roller (44) is between 24% and 38%, preferably between 25% and 30%.

As a skilled person can understand, the capillary membrane as described above can also be provided not only as a cylindrical one supported by the internal structure of the drum, but also as a continuous loop that winds on the capillary cylinder and then has its own conditioning path outgoing the winding area of the capillary cylinder itself.

Figure 3:
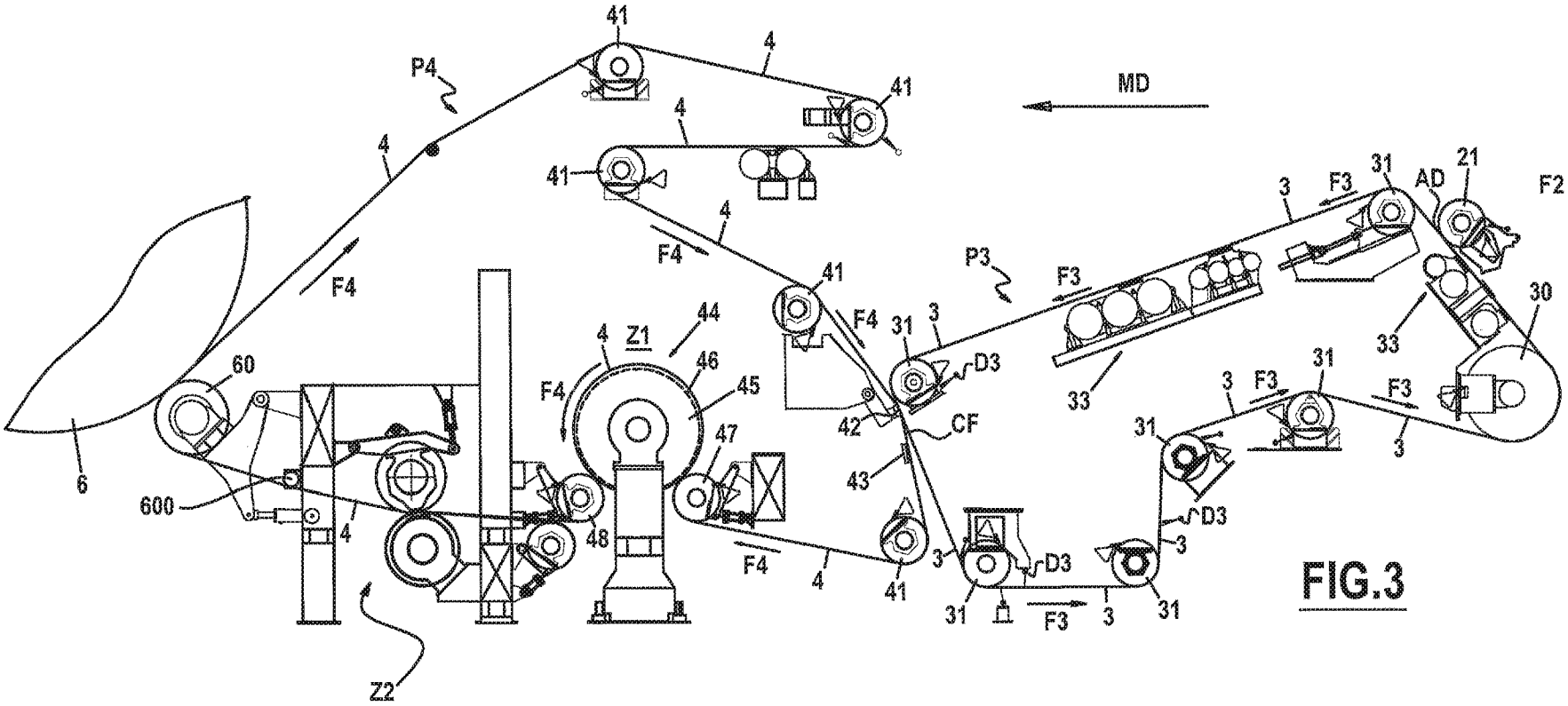
Figure 4:
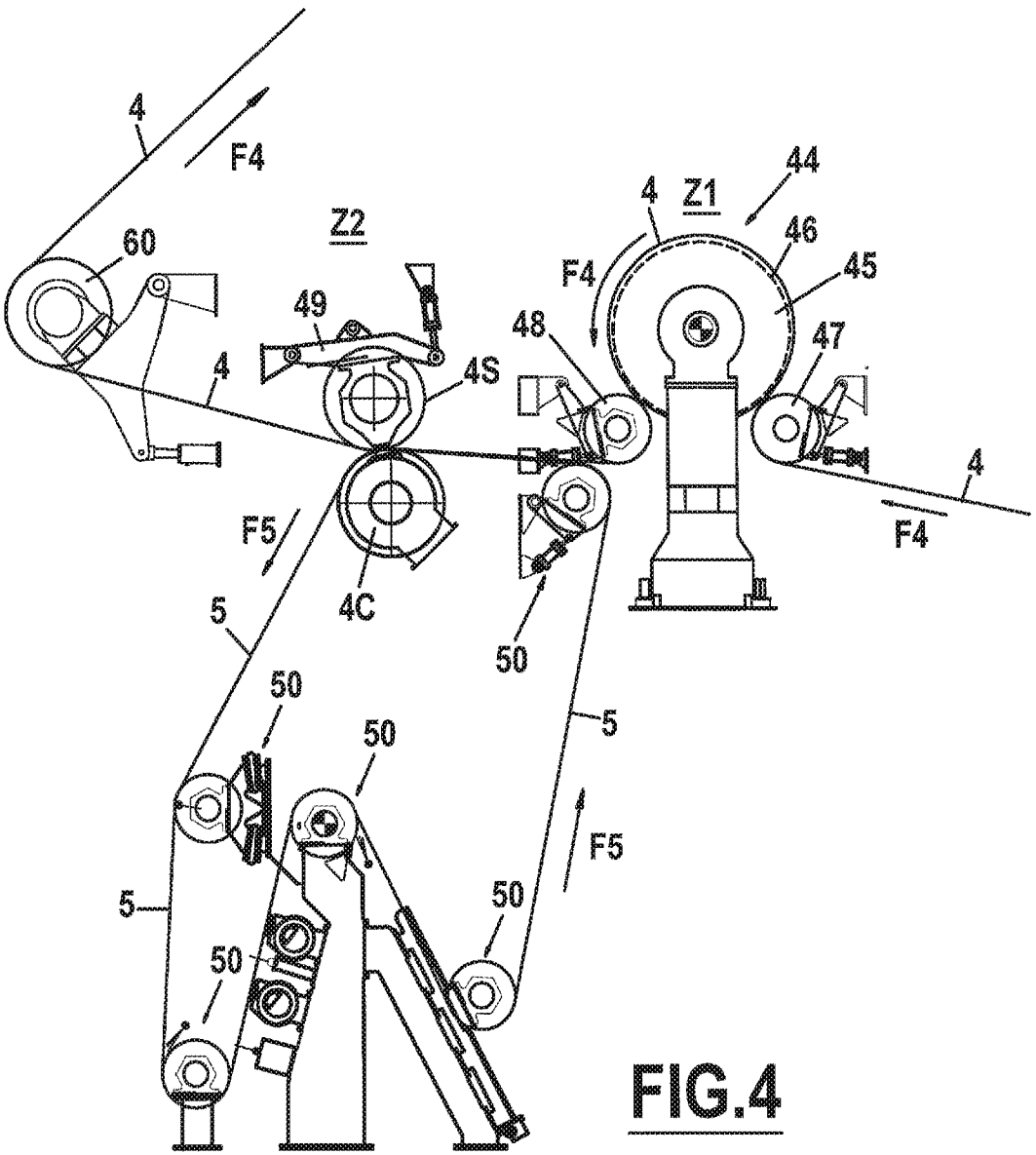

In the second water removal zone (Z2) there is a pressing zone comprising a pressure element (element provided with the movement and with the means for obtaining the movement allowing to open and close the linear pressure zone or nip in the pressing zone) coupled to a counter-roller (element located in a fixed position, possibly equipped with adjustment means to adjust the working position during the machine stop phases). The pressure element can be a perforated roller having a suction sector, a roller without suction means or, preferably, a shoe press. The counter-roller can be a perforated roller equipped with suction, means (preferable solution if coupled with a shoe press or a non-suctioned roller) or a roller without suction devices. The position of the pressure element with respect to the counter-roller can be indifferently higher or lower. The web (4) exiting from the first water removal zone (Z1) crosses the second zone (Z2) passing between a pressure element (4S) coupled to a counterroller (4C), as described above. In the representation of FIG. 4 the pressure element (4S) is placed above the counter-roller (4C), however, the possibility remains of adopting a specular configuration with respect to the web (4), i.e. with the pressure element (4S) placed below the counter-roller (4C). The pressure element (4S) is mounted on corresponding supports (49) allowing it to be separated from the counter-roller (4C) and respectively to be pushed towards the latter to create a first machine configuration in which the pressure element (4S) is inactive and a second machine configuration in which the pressure element (4S) is active. In accordance with what is exemplified in the drawings and in a preferred configuration, the pressure element (4S) is a shoe press and it is above the counter-roller (4C) which is a suction roller. The counter-roller (4C) is inside the closed path (P5) of a web (5) which helps to further increase the dehydration of the fibrous material in the second water removal zone (Z2). In a preferred configuration, the web (5) is a felt. On the path (P5) of the web (5) are positioned conditioning, tensioning and guiding devices of the type commonly used to condition, tension and guide the webs in machines for producing paper and generally indicated with the reference "50" in the attached drawings. In the drawings, the arrows "F5" indicate the movement of the web (5) along the path (P5). The web (5) comes into contact with the fibrous material, while the pressure element (4S) comes into contact with the web (4) on the opposite side, that is, with the internal side of the latter. In FIG. 3 the reference "600" indicates a guide roller for the web (4) exiting the zone (Z2) suitably positioned to favor the separation of the paths (P4) and (P5) exiting from this zone.

In the second water removal zone (Z2) an increase in the dry content in the fibrous material is achieved and the moisture profile of the material is equalized in the transverse direction (direction commonly called "CD").

Figure 7:
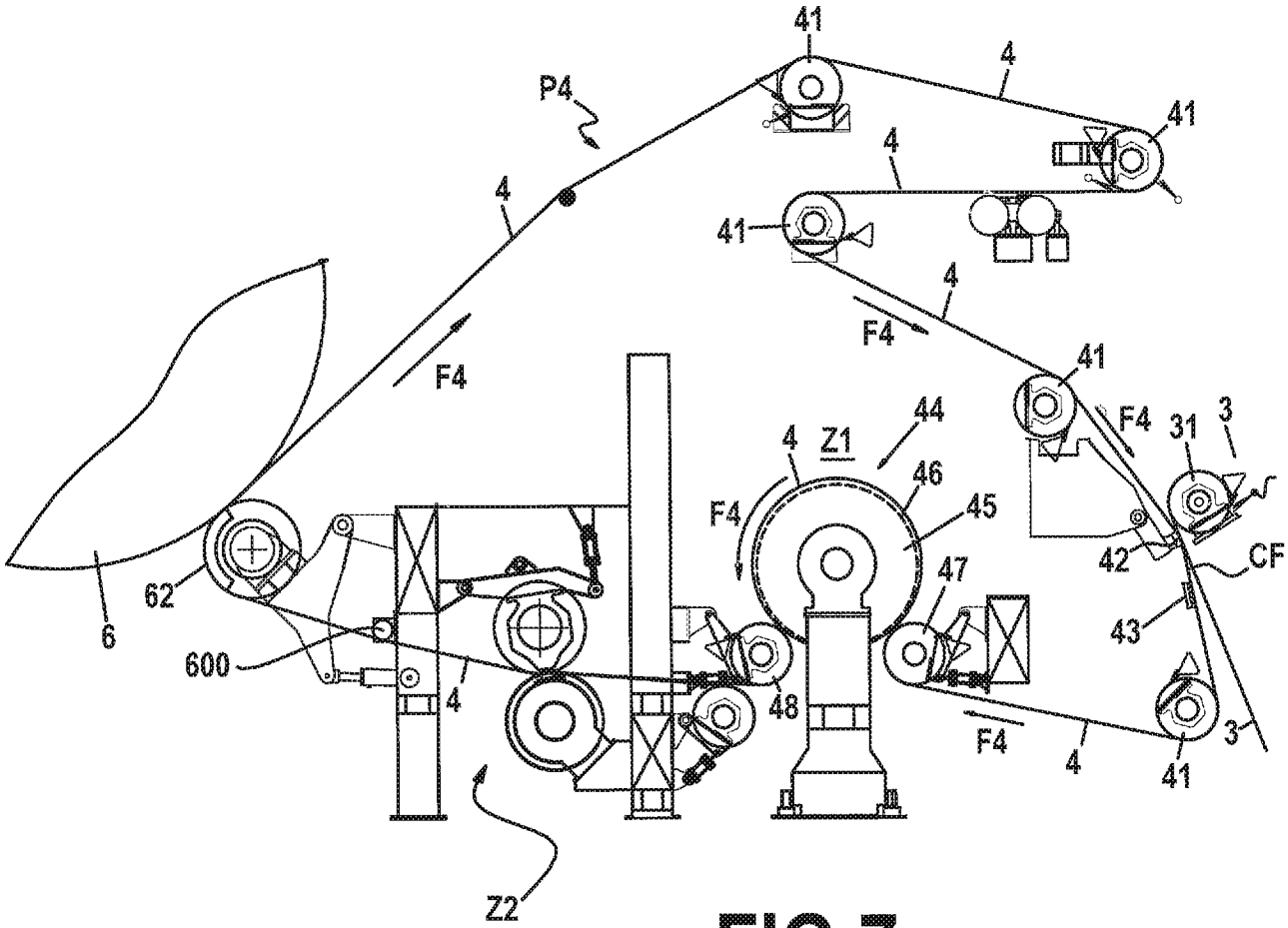
FIGS. 7-8 are graphic representations similar to FIGS. 2-4 relating to further alternative embodiments of a machine in accordance with the present invention. The following description provides embodiment examples of a machine in accordance with the present invention.
Figure 8:
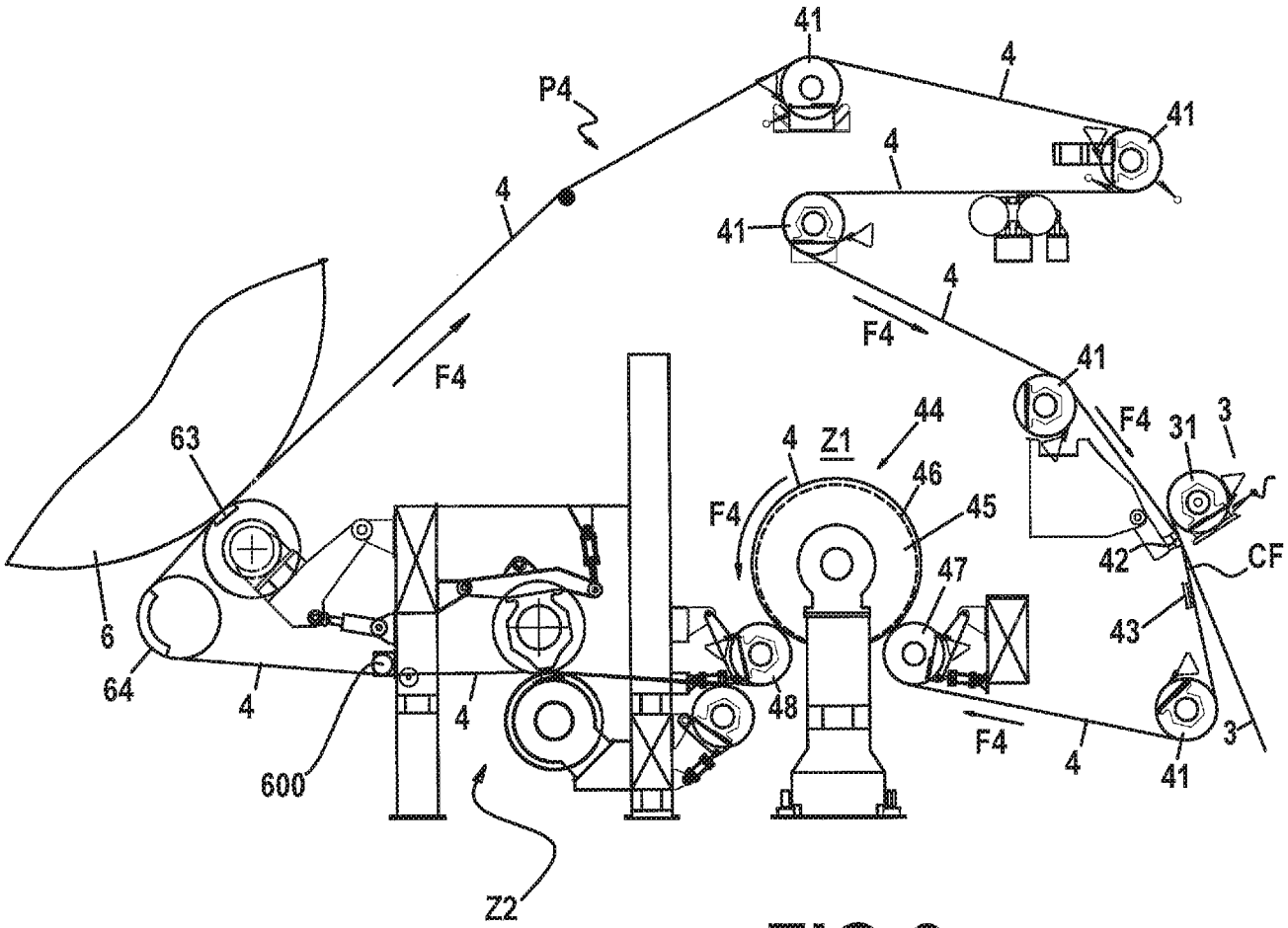

Subsequently, the paper coming out of the zone (Z2) adheres to the surface of a Yankee (6), preferably a steel Yankee with the aid of a transfer roll (60). The latter is a rubber-coated roller with smooth or grooved coating or with blind holes or with one or more of these combined characteristics, which is pressed against the surface of the Yankee (6) with a linear pressure between 40 kN/m and 120 kN/m, preferably between 50 kN/m and 80 kN/m. Instead of the transfer roll (60), a suction press (62) can also be used, as schematically represented in FIG. 7, or a shoe press (63) as schematically represented in FIG. 8, upstream of which a suction roller (64) is provided.

The transfer roll (60) is not specifically intended to remove further water from the paper (although it can give a contribution in this sense) but is used to favor the adhesion of the paper to the surface of the Yankee (6) which instead determines a further removal of the water from the paper by evaporation, so that the dry content of the paper exiting from the Yankee will generally be between 85% and 98% and more typically between 93% and 97%. The transfer roller (60) preferably exerts on the paper a pressure that is. just sufficient to detach it from the structured wire (4) during the phase of adhesion to the Yankee (6) in order not to exert a crushing action which would reduce the volume of the paper if the web (4) is able to provide the layer of fibrous material with a three-dimensional structure (as, for example, in the case of a TAD wire).

The adhesion of the paper to the Yankee (6) is favored by the organic coating suitably sprayed on the surface of the Yankee immediately upstream of the transfer roller (60) by means of sprayers arranged in a suitable position for the purpose. The coating, the composition of which is known to those skilled in the art, contains adhesive substances suitable for overcoming the resistance of the paper to detachment from the web (4).

Finally, the paper is removed by scraping at the end of the drying process on the Yankee (6). The creping determined by the detachment of the paper from the Yankee (6) will generally be between 5% and 15% (preferably between 8% and 10%) for toilet paper and less than 8% (preferably between 2% and 3%) for the towel type paper.

The drawings also show a hood (61), known per se, arranged on the Yankee (6). The paper coming out of the Yankee can then be subjected to other processes in a station (FP) downstream of the Yankee, such as winding.

Figure 5:
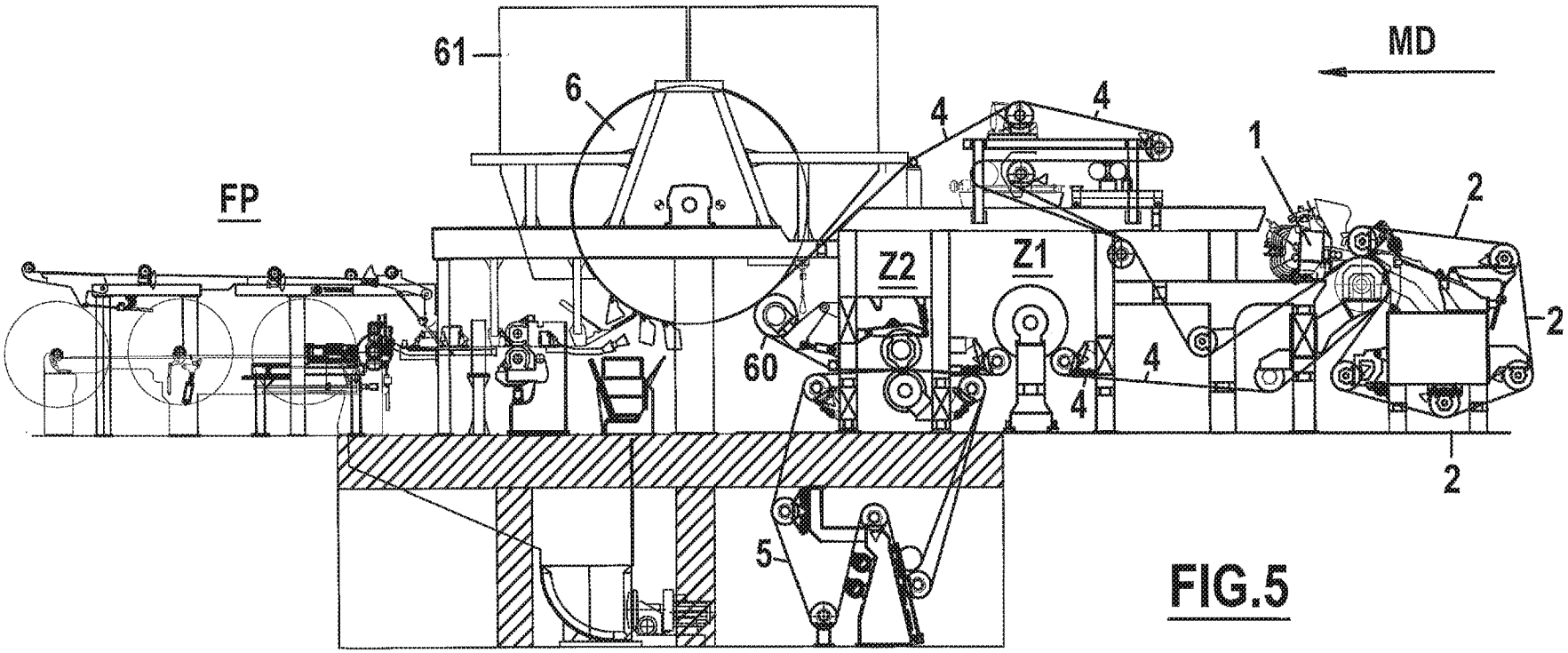
FIG. 5 represents a schematic side view of a paper making machine according to a further embodiment of the present invention.
Figure 6:
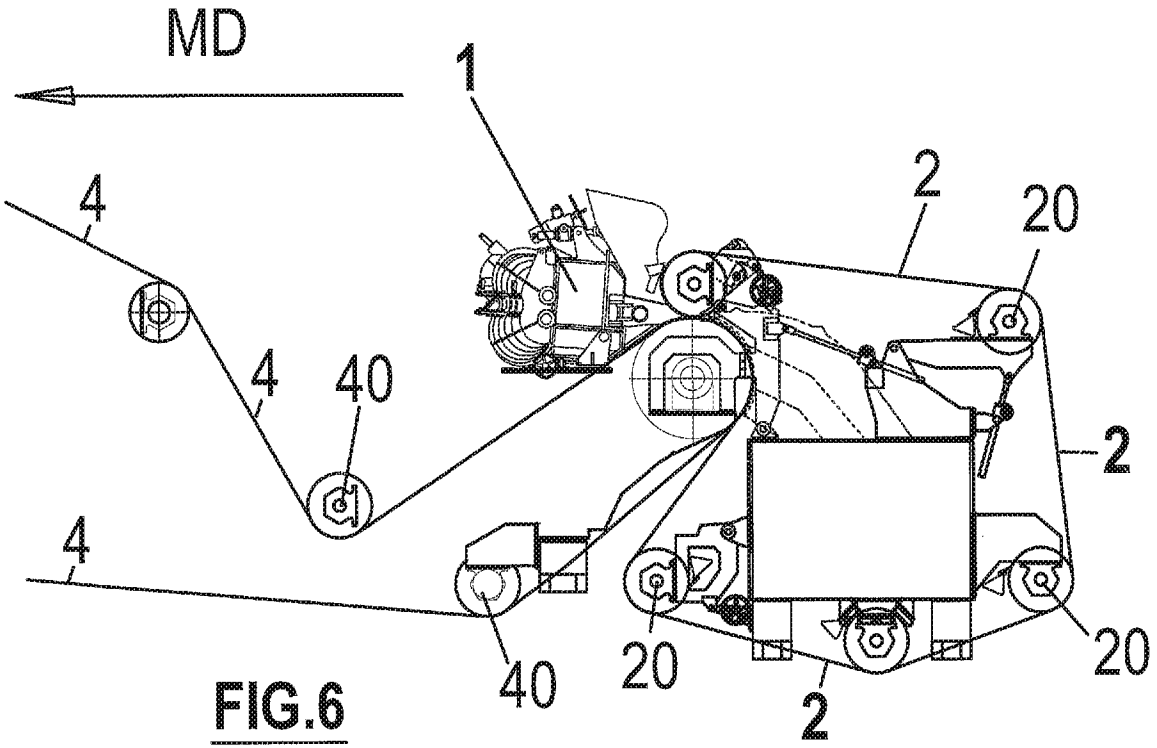
FIG. 6 is an enlarged detail of FIG. 5.

Although the above description refers to the formation of the layer of fibrous material with a double wire forming system (2, 3), the present invention is equally applicable to machines of the crescent former type. FIG. 5 shows a machine according to the present invention in which the formation zone of the layer of fibrous material is in a crescent former configuration. FIG. 6 represents the forming zone of the machine of FIG. 5 and illustrates, in particular, the headbox (1) which injects the mixture between the forming wire (2) and the web (4) guided on the cylinder (30). The sections of the machine downstream of the zone where the layer of fibrous material is formed are identical to those of the example described above.

Ultimately, in accordance with the present invention, a paper making machine is provided comprising a formation zone in which a layer of fibrous material is formed, a zone for forced removal of water from the layer of fibrous material downstream of the formation zone, a drying zone downstream of the forced water removal zone, and a paper collection zone downstream of the drying zone, and means for transporting the layer of fibrous material through said zones of the machine along a path that follows a predetermined transport direction (MD), in which the forced water removal zone comprises, in turn, two consecutive zones (Z1, Z2) along said transport direction (MD), in which are provided a capillary roller (44) and respectively a pressure element (4S) with relative counter-roller (4C) acting consecutively on the layer of fibrous material upstream of the drying zone.

In accordance with desired embodiments of the present invention, the machine described above can have one or more of the following characteristics:

- the layer of fibrous material is supported by a conveyor belt (4) which crosses the zone (Z2) where the pressure element (4S) is arranged while it is pressed, in correspondence with a nip, against another belt (5) placed between the pressing element (4S) and the counter-roller (4C).
- the further belt (5) is a felt.
- the pressure element (4S) is a shoe press.
- the counter roller (4C) is a suction roller.
- the means for transporting the layer of fibrous material in said two consecutive zones (Z1, Z2) comprise a transport belt (4) which is consisted of a structured wire or TAD wire.
- the means for transporting the layer of fibrous material in said two consecutive zones (Z1, Z2) comprise a transport belt which is constituted by a felt which can be provided with reliefs on the paper-side in polymeric material.
- the means for transporting the layer of fibrous material in said two consecutive zones (Z1, Z2) comprise a transport belt coated with polymeric material in which the paper-side surface has drainage holes or reliefs.
- the pressure element (4S) is selectively activated and deactivated.
- the forming zone of the machine includes a forming wire (2) and a conveyor belt (3) which acts as a means of transport for the layer of fibrous material towards the forced water removal zone.
- the forming zone of the machine comprises a forming wire (2) and a conveyor belt (4) which acts as a means of transport for transporting the layer of fibrous material both through the forced water removal zone and through the zone of drying.
- the means of transporting the layer of fibrous material comprise, in addition to a structured wire (4) which crosses the said consecutive zones (Z1, Z2) of the forced water removal zone, also a transport wire (3) which transports the layer of fibrous material from the formation zone to the forced water removal zone, and by the fact that the structured wire (4) and the transport wire (3) are configured to carry out the transfer of the layer of fibrous material from the transport (3) to the structured wire (4) in rush transfer mode, with the structured wire (4) having a lower speed than the transport wire (3).
- the drying zone of the machine comprises a Yankee (6) and the layer of fibrous material coming out of said forced water removal zone (Z1, Z2) is transferred to the Yankee (6) by means of a transfer device selected from a group comprising a transfer roll (60), a suction press (62) or a shoe press (63), on which the means for transporting the layer of fibrous material are guided.

It is also clear, from the above description, that a process for the production of paper in compliance, of the present invention comprises a formation step in which a layer of fibrous material is formed, a step of forced removal of water from the layer of fibrous material downstream of the formation step, a drying step downstream of the step of forced removal of the water, and a paper collection phase downstream of the drying phase, and the transport of the layer of fibrous material along a path that follows a predetermined transport direction (MD) and along which the aforementioned operating phases are carried out in succession, in which the step of forced removal of the water comprises, in turn, two consecutive steps in which the layer of fibrous material passes over a capillary roller (44) and respectively a pressure element (4S) with relative counter-roller (4C) acting consecutively on the layer of fibrous material upstream of the drying step.

In accordance with desired embodiments of a process in accordance with the present invention, the process may exhibit one or more of the following characteristics:

- the layer of fibrous material is supported by a conveyor belt (4) which crosses the zone (Z2) where the pressure element (4S) is arranged while it is pressed, in correspondence with a nip, against another belt (5) placed between the pressing element (4S) and the counter-roller (4C).
- the further belt (5) is a felt.
- the pressure element (4S) is a shoe press.
- the counter roller (4C) is a suction roller.
- the means for transporting the layer of fibrous material in said two consecutive zones (Z1, Z2) comprise a transport belt (4) which is constituted by a structured wire or TAD wire.
- the means for transporting the layer of fibrous material in said two consecutive zones (Z1, Z2) comprise a transport belt which is constituted by a felt which can be provided with reliefs on the paper-side of polymeric material.
- the means for transporting the layer of fibrous material in said two consecutive zones (Z1, Z2) comprise a transport belt coated with polymeric material in which the paper-side surface has drainage holes or reliefs.
- the pressure element (4S) is selectively activated and deactivated.
- the forming zone of the machine includes a forming wire (2) and a conveyor belt (3) which acts as a means of transport for the layer of fibrous material towards the forced water removal zone.
- the forming zone of the machine comprises a forming wire (2) and a conveyor belt (4) which acts as a means of transport for transporting the layer of fibrous material both through the forced water removal zone and through the drying zone.
- the means of transporting the layer of fibrous material comprise, in addition to a structured wire (4) which crosses the said consecutive zones (Z1, Z2) of the forced water removal zone, also a transport wire (3) which transports the layer of fibrous material from the formation zone to the forced water removal zone, and by the fact that the structured wire (4) and the transport wire (3) are configured to carry out the transfer of the layer of fibrous material from the transport (3) to the structured wire (4) in rush transfer mode, with the structured wire (4) having a lower speed than the transport wire (3).
- the drying zone of the machine comprises a Yankee (6) and the layer of fibrous material coming out of said forced water removal zone (Z1, Z2) is transferred to the Yankee (6) by means of a transfer device selected from a group comprising a transfer roll (60), a suction press (62) or a shoe press (63), on which the means for transporting the layer of fibrous material are guided.

In practice, the details of execution can in any case vary in an equivalent way as regards the individual elements described and illustrated, without thereby departing from the solution technique adopted and therefore remaining within the limits of the protection granted by this patent in accordance with the following claims.

The invention claimed is:

1. A process for production of paper comprising a formation step in which a layer of fibrous material is formed, a step of forced removal of water from the layer of fibrous material downstream of the formation step, a drying step downstream of the forced water removal step, and a paper collection step downstream of the drying step, wherein the transport of the layer of fibrous material along a path that follows a predetermined transport direction (MD) is executed by means for transporting the layer of fibrous material, along said path said operating steps are executed in succession, characterized in that the forced removal of the water step includes, in turn, two consecutive steps in which the layer of fibrous material passes over a capillary roller (44) and a pressure element (4S) with a respective counter-roller (4C) acting consecutively on the layer of fibrous material upstream of the drying step, the two consecutive steps being performed in two consecutive zones (Z1, Z2) along said transport direction (MD), in which are respectively arranged the capillary roller (44) and the pressure element (4S) with the respective counter-roller (4C) such that the capillary roller (44) and the pressure element (4S) with the respective counter-roller (4C) act consecutively on the layer of fibrous material.

2. The process according to claim 1 characterized in that the layer of fibrous material is supported by a conveyor web (4) which crosses the zone (Z2) where the pressure element (4S) is arranged while it is pressed, in correspondence with a nip, against a further web (5) placed between the pressing element (4S) and the counter-roller (4C).

3. The process according to claim 1, wherein the layer of fibrous material is supported by a conveyor web (4) which crosses the zone (Z2) where the pressure element (4S) is arranged while it is pressed, in correspondence with a nip, against a further web (5) placed between the pressing element (4S) and the counter-roller (4C), process characterized in that the further web (5) is a felt.

4. The process according to claim 1 characterized in that the pressure element (4S) is a shoe press.

5. The process according to claim 1 characterized in that the counter-roller (4C) is a suction roller.

6. The process according to claim 1 characterized in that the means for transporting the layer of fibrous material in said two consecutive zones (Z1, Z2) comprise a transport web (4) that is constituted by a structured fabric or TAD fabric.

7. The process according to claim 1 characterized in that the means for transporting the layer of fibrous material in said two consecutive zones (Z1, Z2) comprise a conveyor web that is constituted by a felt which can be provided with reliefs of polymeric material on the paper side.

8. The process according to claim 1 characterized by the fact that the means for transporting the layer of fibrous material in said two consecutive zones (Z1, Z2) comprise a web (4) coated with a polymeric material, in which the paper side surface has drainage holes or reliefs.

9. The process according to claim 1 characterized in that the pressure element (4S) is selectively activated and deactivated.

10. The process according to claim 1 characterized in that the forming zone of the machine comprises a forming wire (2) and a conveyor web (3) which acts as a means of transport for the layer of fibrous material towards the forced water removal zone.

11. The process according to claim 1 characterized in that the forming zone of the machine comprises a forming wire (2) and a web (4) which acts as a transport means for transporting the layer of fibrous material both through the forced water removal zone and through the drying zone.

12. The process according to claim 1 characterized in that the means for transporting the layer of fibrous material comprise, in addition to a structured fabric (4) which crosses said consecutive zones (Z1, Z2) of the forced water removal zone, also a transport wire (3) which transports the layer of fibrous material from the formation zone to the forced water removal zone, and in that the structured fabric (4) and the transport wire (3) are configured for performing the transfer of the layer of fibrous material from the transport wire (3) to the structured fabric (4) in rush transfer mode, with the structured fabric (4) having a slower speed than the transport web (3).

13. The process according to claim 1 characterized in that the drying zone of the machine comprises a Yankee (6) and the layer of fibrous material coming out of said zone (Z1, Z2) for forced removal of water is transferred to the Yankee (6) by means of a transfer device selected within a group comprising a transfer roll (60), a suction press (62) or a shoe press (63), on which the means for transporting the layer of fibrous material are guided.

* * * * *